US005913553A

United States Patent [19]

Takada

[11] Patent Number: 5,913,553

[45] Date of Patent: Jun. 22, 1999

[54] METHOD OF MANUFACTURING A WIRING HARNESS

[75] Inventor: Kazuhiko Takada, Haibara-gun, Japan

[73] Assignee: Yazaki Corporation, Tokyo, Japan

[21] Appl. No.: 08/857,249

[22] Filed: May 16, 1997

[30] Foreign Application Priority Data

May 20, 1996 [JP] Japan ..... 8-124967

[51] Int. Cl.[6] ..... H01R 43/04

[52] U.S. Cl. ..... 29/861; 29/33 F; 29/33 M; 29/749; 29/755

[58] Field of Search ..... 29/867, 749, 861, 29/755, 33 M, 33 F

[56] References Cited

U.S. PATENT DOCUMENTS

| | | | |
|---|---|---|---|
| 4,194,281 | 3/1980 | Gudmestad | 29/867 |
| 4,486,950 | 12/1984 | Weidler . | |
| 4,492,023 | 1/1985 | Schneider et al. | 29/749 X |
| 4,590,650 | 5/1986 | Brown et al. . | |
| 4,628,600 | 12/1986 | Gordon et al. | 29/861 |
| 4,638,549 | 1/1987 | Okazaki | 29/749 X |
| 4,856,187 | 8/1989 | Blaha | 29/867 |
| 4,862,587 | 9/1989 | Nakata et al. | 29/867 |
| 5,082,253 | 1/1992 | Suzuki et al. . | |
| 5,127,159 | 7/1992 | Kudo et al. . | |
| 5,355,583 | 10/1994 | Osumi et al. . | |
| 5,606,795 | 3/1997 | Ohba et al. | 29/863 |

FOREIGN PATENT DOCUMENTS

| | | |
|---|---|---|
| 0 403 115 A2 | of 0000 | European Pat. Off. . |
| 403115 | 12/1990 | European Pat. Off. . |
| 6-223646 | 8/1994 | Japan . |

*Primary Examiner*—Carl J. Arbes

*Attorney, Agent, or Firm*—Armstrong, Westerman, Hattori, McLeland & Naughton

[57] ABSTRACT

A press-fitting unit includes a vertically movable press blade for press-fitting a stripped end of an electrical wire to a terminal disposed in a connector. A connector retaining bar movable in a horizontal direction is disposed to be opposed to the press blade. The retaining bar is provided with a plurality of connector receiving recesses in parallel to respectively hold a connector with a press-fit terminal. A wire chuck is disposed so as to opposing to the rear part of the press blade. The wire chuck is horizontally movable along a horizontal guide to a side of the press blade so as to holding the wire. Alternatively, the connector retaining bar is fixed to the apparatus by a frame and a transfer mechanism can carry the press-fitting unit along the bar in a horizontal direction. In addition, the apparatus may have a pair or two pairs of the upper and lower symmetrical press-fitting units; and the connector retaining bar is disposed between the upper and lower press-fitting units.

1 Claim, 21 Drawing Sheets

METHOD OF MANUFACTURING A WIRING HARNESS

BACK GROUND OF THE INVENTION

1. Field of the Invention

The present invention relates to a manufacturing method of a wiring harness subassembly having both crimp-type terminals and press-fit-type terminals. Further, the invention relates to equipment for implementation of the manufacturing method, which includes a press-fitting unit, a connector retaining bar holding connectors in parallel, and a press-fitting apparatus with the connector retaining bar.

2. Description of the Prior Art

FIGS. 18 to 22 show a known manufacturing method of a wiring harness using crimped terminals.

In the method, the first step is cutting an electrical wire 14 into desired lengths. Next, each end 14*a* or 14*b* of the wire 14 is stripped off to expose a conductor 14*c* (stages 101, 102 in FIG. 18) as illustrated in FIG. 19. Then, the conductor 14*c* is crimped to a terminal 12 for connection (stage 103 in FIG. 18) as illustrated in FIG. 20. And, after correct arrangement (stage 104 in FIG. 18) of the wire 14 with the terminal, a chuck 109 holds the wire 14 near the end 14*a*. Further, the terminal equipped wires are sequentially forced into clips 111 formed in a wire retaining bar 110 (stage 105 in FIG. 18) as illustrated in FIG. 21. Finally, with picking up an end portion of the wire 14 from the clip 111, a chuck 112 inserts the terminal into a connector housing 13 (stage 106 in FIG. 18) as illustrated in FIG. 22. Thence, these steps complete a wiring harness subassembly (stage 107 in FIG. 18).

Meanwhile, FIGS. 23 to 24 show another known manufacturing method of a wiring harness using a press-fit terminal 10. In the method, a wire 14 having been cut into a desired length, without stripping off each end thereof, is forced to enter into a press-fit terminal 10 disposed in a connector housing 11*a* by a vertically moving blade 32 (stages 113 and 114). The application of these steps to plural connector 11 competes a wiring harness subassembly (stage 115 in FIG. 23).

The connector 11 has press-fit terminals 10 disposed in upper and lower open compartments 116 formed between partitions in its connector housing 11*a* made of a synthetic resin (a double-sided press-fitting terminal connector). After the wires have been press-fitted, the closure of a cover plate 117 protects the press-fitted terminals.

However, in the known manufacturing method of a wiring harness using crimp terminals 12 is produced separately from a wiring harness utilizing press-fit terminals 10. This has not been able to efficiently produce various types of wiring harnesses including both the crimp terminals 12 and the press-fit terminals 10.

In view of the foregoing disadvantage, an object of the invention is to provide a manufacturing method of a wiring harness using both crimp terminals and press-fit terminals and to obtain means for the same, which includes a press-fitting apparatus.

SUMMARY OF THE INVENTION

For achieving the object, a manufacturing method of a wiring harness according to the invention includes the steps of:

stripping off one end of an electrical wire;

crimping the one end of the wire to a crimping terminal;

press-fitting the other end of the wire in a terminal of a connector; and inserting the crimped terminal into a connector housing, which accomplishing a wiring harness subassembly having both the crimped wire end and the press-fitted wire end.

Another manufacturing method of a wiring harness according to the invention for press-fitting one stripped end of an electrical wire to a press-fit-type terminal of a connector by a press-fitting unit having a vertically movable press blade, including the steps of:

disposing in parallel a plurality of connectors having the press-fit-type terminal on a connector retaining bar;

press-fitting the stripped end of the wire to the press-fit-type terminal of the connector by the press-fitting unit;

horizontally transferring the connector retaining bar or the press-fitting unit;

press-fitting one stripped end of another wire to a press-fit terminal of another connector; and repeating sequentially the horizontally transferring step and the press-fitting step, which accomplishing a wiring harness subassembly mounted on the connector retaining bar. Further, the press-fitting step may be carried out with the stripped end of the wire having been cut in a desired length and having being held by a wire chuck at one end thereof.

Moreover, the invention provides a press-fitting unit including:

a vertically movable press blade for press-fitting an electrical wire to a press-fit-type terminal of a connector; and an upwardly resiliently loaded wire chuck disposed so as to abut against a rear part of the press blade so that the chuck can unitedly move with the press blade.

The wire chuck may be horizontally movable along a horizontal guide and can horizontally move to a side of the press blade with holding the wire. A couple of the horizontal guides advantageously extend in parallel respectively at each side of the press blade; and the wire chuck can move on the couple of horizontal guides.

Further, the press-fitting unit effectively includes a pair of wire guides each disposed along each side of the press blade and spring-loaded toward the connector, a fore end of each of the wire guides being positioned at each side of the press-fit-type terminal disposed in the connector.

Additionally, this invention provides a connector retaining bar, which includes a longitudinally extending base plate provided with a plurality of connector receiving recesses in parallel, each of the connector receiving recesses being able to hold a connector with a press-fit-type terminal. A plurality of parallel connector supports may be disposed on and held by the base plate, the connector supports respectively having one of the connector receiving recesses.

This invention further provides a press-fitting apparatus having:

a press-fitting unit including a vertically movable press blade for press-fitting an electrical wire to a terminal disposed in a connector, a frame for fixing the press-fitting unit to the apparatus, a connector retaining bar disposed opposite to the press blade and movable in a horizontal direction, and a transfer mechanism for transferring the bar, wherein the connector retaining bar is provided with a plurality of connector receiving recesses in parallel.

Alternatively, the connector retaining bar may be fixed to the apparatus by a frame while and a transfer mechanism for transfers the press-fitting unit along the bar in a horizontal direction.

In addition, the apparatus has a pair or two pairs of upper and lower symmetrical press-fitting units; and the connector retaining bar is disposed between the upper and lower press-fitting units. The press-fitting units may respectively include an upwardly loaded wire chuck disposed so as to abut against a member jointed to the press blade.

Further, the apparatus can press-fit electrical wires to a couple of double-sided terminals mounted in a relative connector. Advantageously, while one side of the connector having double-sided terminal has been supported by the opposing wire guide, the wire is press-fitted into the other side terminal.

DETAILED DESCRIPTION OF THE PREFERRED EMBODIMENTS

Referring to the accompanied drawings, a specified embodiment of the invention will be discussed in detail hereinafter.

FIGS. 1 to 5 shows an embodiment a manufacturing method of a wiring harness according to the invention.

Figure 1:
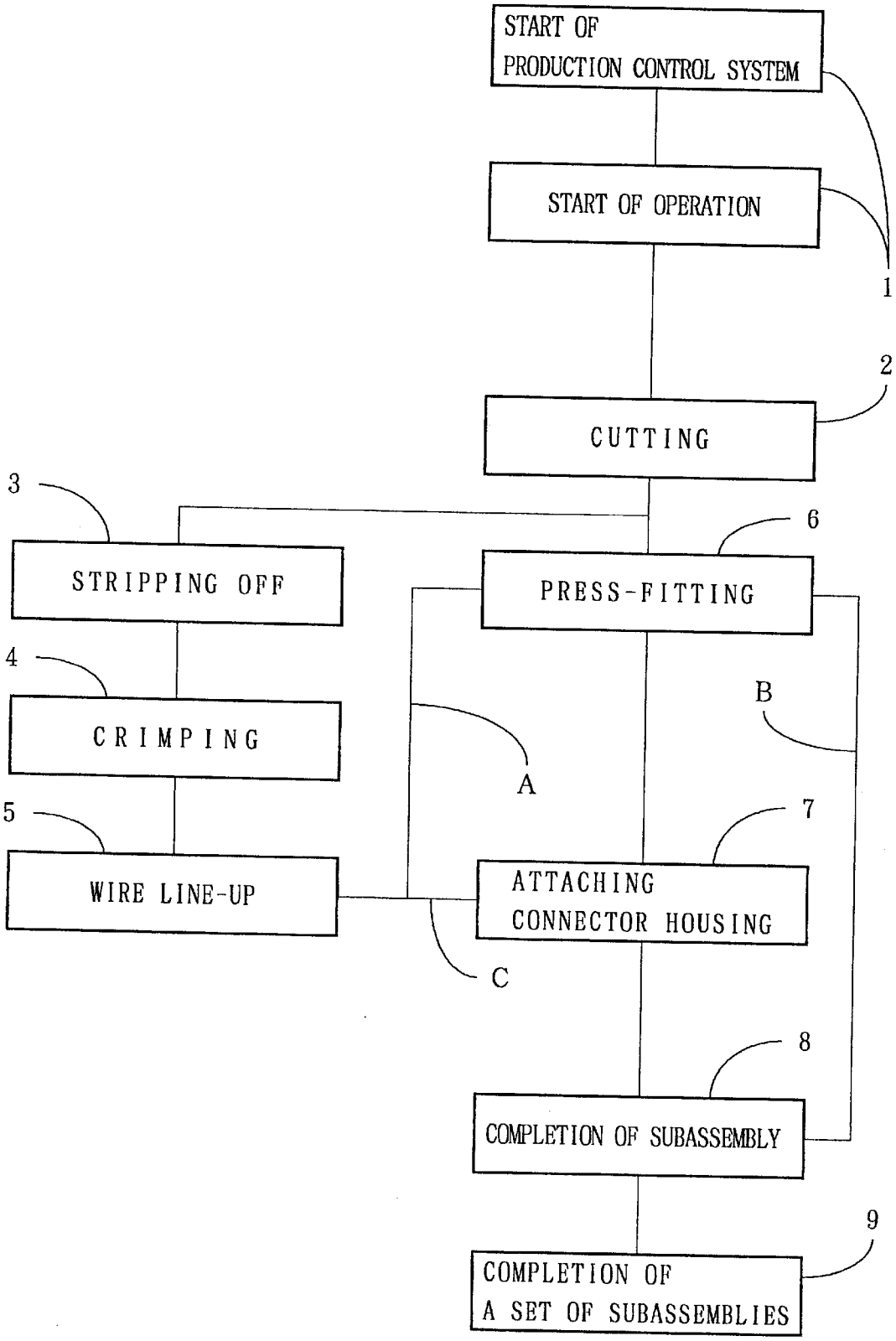
FIG. 1 shows a block diagram of a manufacturing method of a wiring harness according to the invention.

The manufacturing method, as shown in FIG. 1, a fabricating stage including both a press-fitting step and a crimping step, utilizing a connector 11 with press-fit terminals 10 (FIG. 3) and a connector 13 with crimp terminals 12 to produce a wiring harness.

Figure 3:
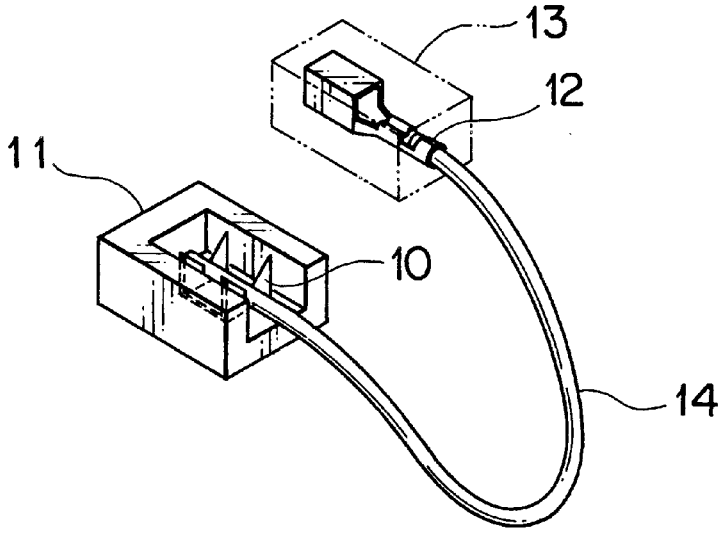
FIG. 3 is a perspective view showing a wiring harness subassembly having both a press-fitting terminal and a crimping one.

Referring to FIG. 1, based on a production control system 1, a cutting stage 2 cuts a wire into a desired length by means of a cutter. Stage 3 strips off an insulation at one end of the wire and stage 4 crimps the stripped end of a conductor to a crimp terminal 12 (FIG. 3). Stage 5 lines up the wires on every type of them for smooth handling and then the wires are delivered along a line A to stage 6 for press-fitting the other end of the wire to the press-fit terminal 10 of the connector 11 (FIG. 3) by the press-fitting unit. Housing stage 7 inserts the crimp terminal 12 into a terminal receiving chamber of a connector housing 13.

Further, in the case of press-fitting 6 both the ends of the wire having been cut in the stage 2 in FIG. 1 to a press-fit terminal type connector, a wiring harness subassembly 8 is accomplished without the stage 7 for fitting a case. Meanwhile, in the case of stripping 3 and crimping 4 both the ends of the wire to the terminals 12, the case fitting stage 7 inserts both the ends of the wire respectively to a connector housing as proceeded along a line C without the stage 6. Wiring harness subassemblies 8 having completed the casing stage 7 and the press-fitting 6 composes a set of subassemblies for each wiring harness.

Besides, the wire cutting step 2 may be provided separately for the press-fitting stage and for the crimping stage. In that, the stripping stage 3 and the crimping stage 4 are the same as conventional ones produced in a lot.

Figure 2:
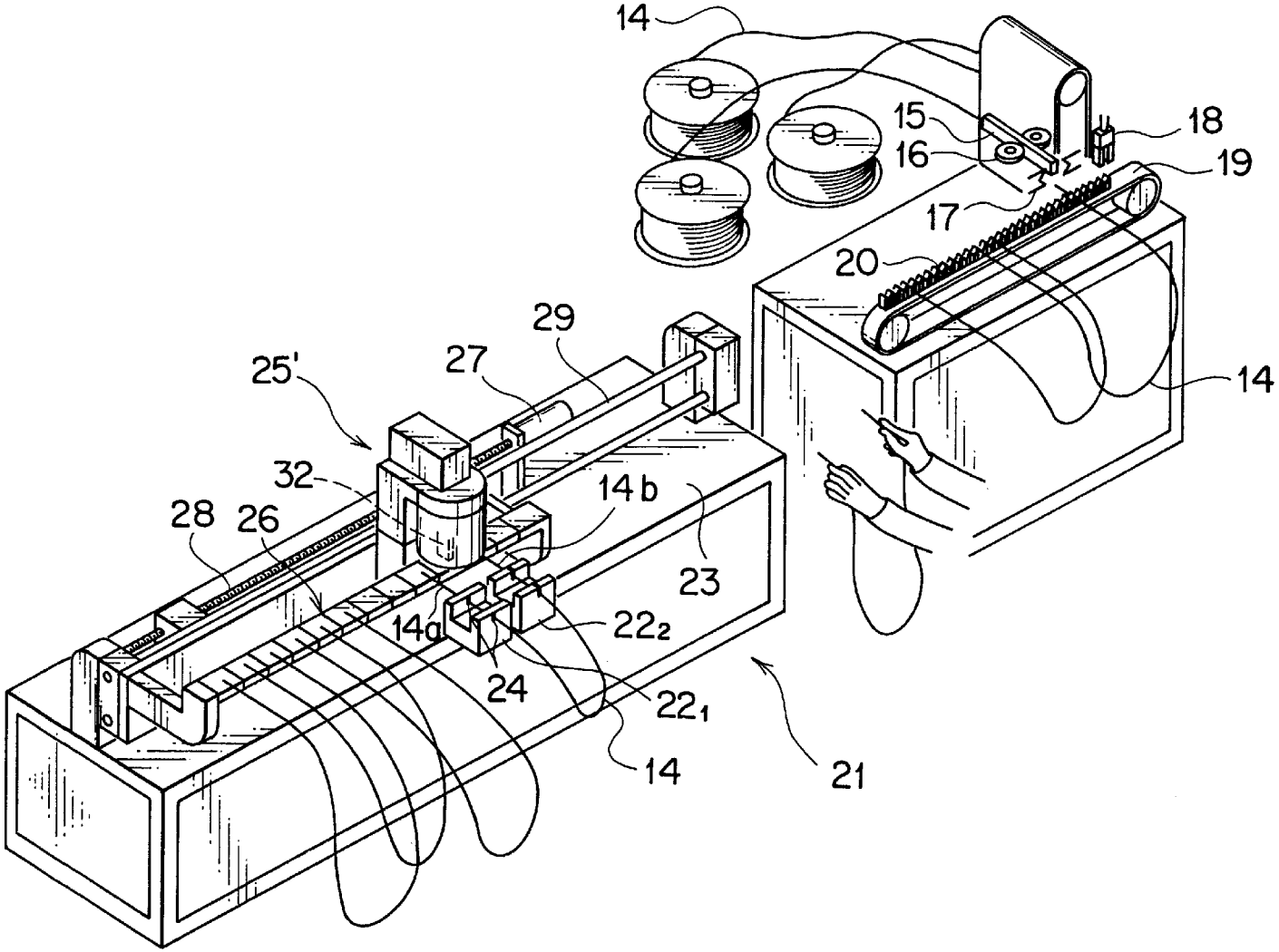
FIG. 2 is a perspective view showing generally a press-fitting apparatus utilized in the wiring harness manufacturing method.

FIG. 2 shows an apparatus for cutting and press-fitting electrical wires.

The wire 14 passes through selective nozzles 15 and is fed by a desired length by a measuring roller 16. Then, a cutter 17 cuts the wire and a U-turn device (not shown) and a chuck 18 for striking-in provisionally holds the wire bent in a U-shape in a clip 20 mounted on a conveyer belt 19.

A worker picks up the wire 14 from the conveyor belt 19 and moves it on a pair of wire chucks 22 ($\mathbf{22}_1$,$\mathbf{22}_2$) of a press-fitting apparatus 21. The wire chucks (wire setting blocks) 22 located on a base frame 23 and formed with a pair of fore and aft, wire supporting channels 24.

Above the chucks 22 there is mounted a press-fitting unit 25'. The press-fitting unit 25', as described after, is fixed on the frame 23. Under the press-fitting unit 25' there is disposed a connector retaining bar 26 horizontally moved along a couple of guide bars 29 by a motor 27 and a ball-screw threaded rod 28. The connector retaining bar 26 has a plurality of several types of press-fit terminal type connectors 11 detachably disposed in parallel thereon.

The press-fitting unit 25' has a vertically movable press blade 32 with each end of the wire 14 having been held by the chuck 22, the downward movement of the press blade 32 press-fits an end 14*a* of the wire 14 at one 221 of the chucks to a press-fit terminal 10 (FIG. 3) arranged in the press-fit connector 11. The chuck 22 can be moved in a horizontal direction (the longitudinal direction of the connector bar) by a transfer mechanism (not shown). After the end 14*a* of the wire 14 has been connected to the connector 11, the other chuck $\mathbf{22}_2$ comes just under the press blade 32. At the same time, the connector retaining bar 26 moves horizontally so that the press blade 32 press-fits the other end 14*b* of the wire 14 a press-fit terminal disposed in the same connector 11 or in an adjacent another connector. Besides, the chuck 22 may have wire handling means (not shown) for elevating and longitudinally transferring the wire.

Figure 4:
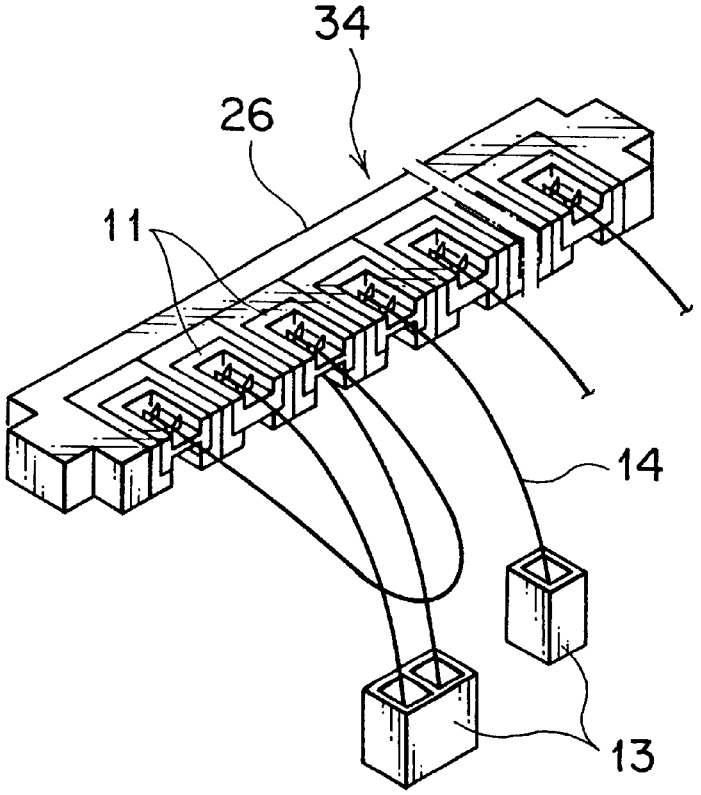
FIG. 4 is a perspective view showing a stage for fabricating wiring harness subassemblies by utilizing a connector retaining bar.
Figure 5:
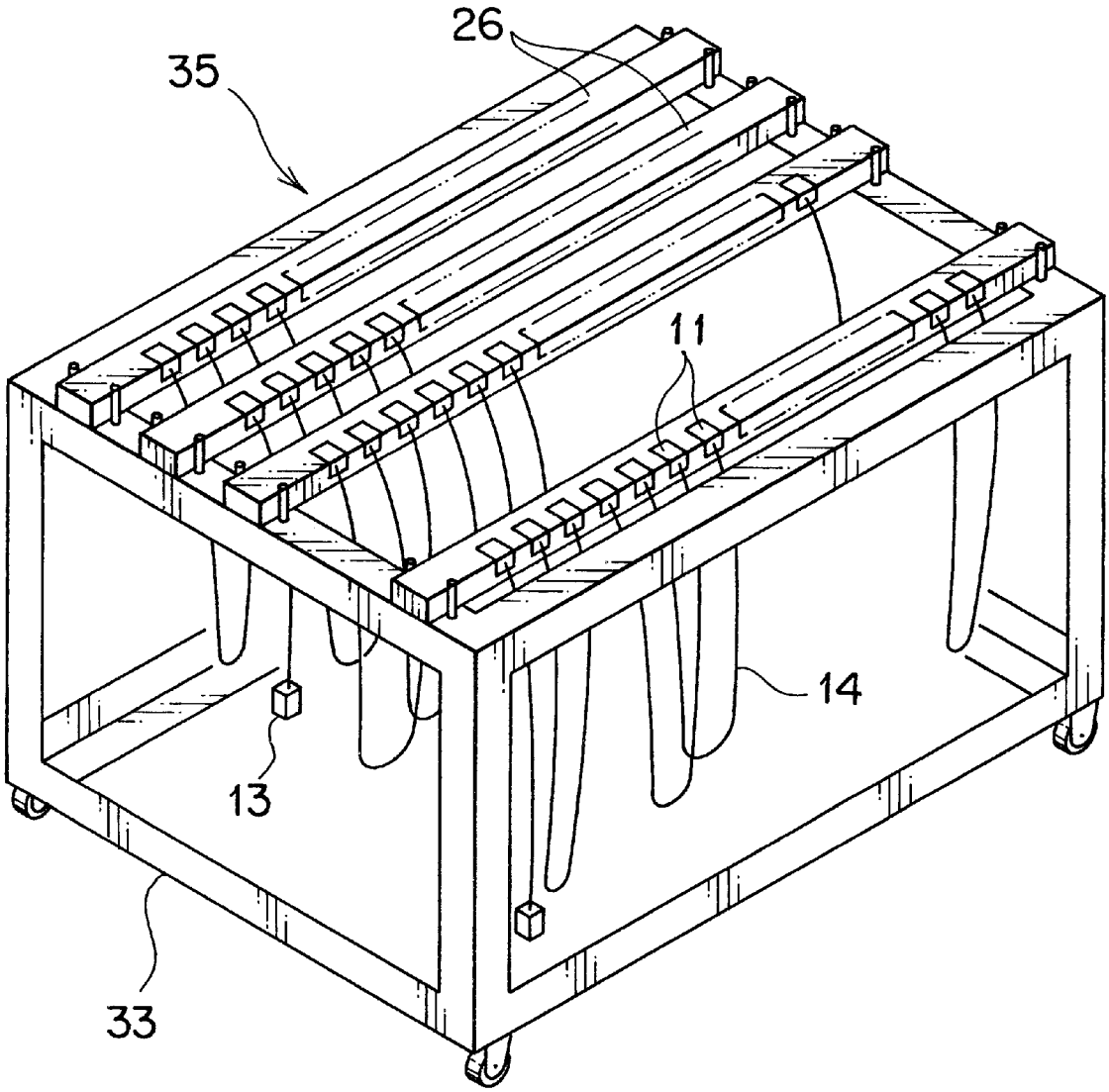
FIG. 5 is a perspective view showing several groups of wiring harness subassemblies set on a respective connector retaining bar.

The wire 14 having been press-fitted in the press-fit type connectors 11 mounted on the connector retaining bar 26, as shown in FIG. 4, is crimped at the other end, the end being capped by a case (a connector housing 13). Finally, all the wires disposed on the single connector retaining bar 26 composes a wiring harness subassembly 34. Then, as shown in FIG. 5, a plurality of the connector retaining bars 26 are laid on a carrier 33 in parallel, composing a group 35 of the subassemblies.

Figure 6:
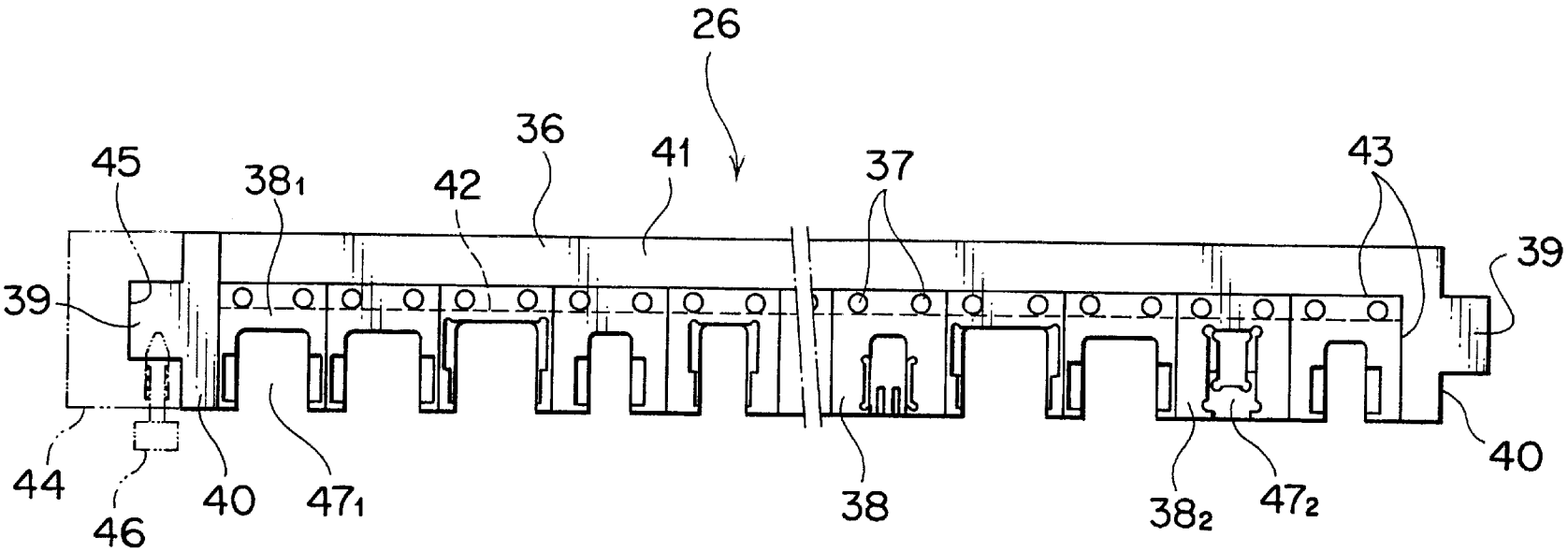
FIG. 6 is a top view of the connector retaining bar.
Figure 7:
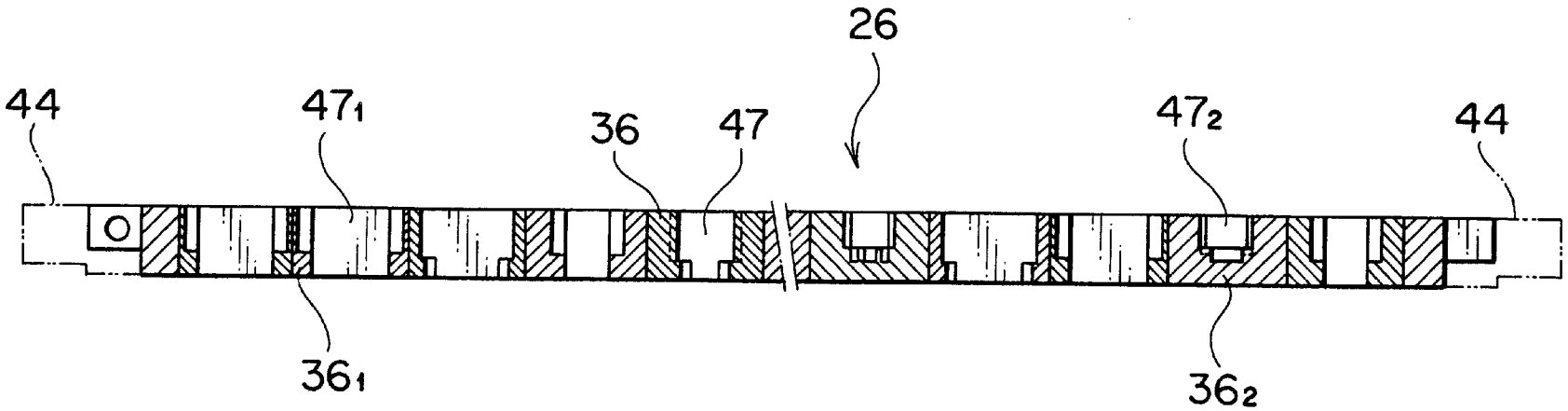
FIG. 7 is the partially omitted front view of the connector retaining bar.

FIGS. 6 and 7 shows an example of the connector retaining bar in retail.

The connector retaining bar 26 is composed of an aluminum base plate 36 and a plurality of aluminum connector supports 38. The supports 38 are fixed in parallel to the base plate 36 with bolts 37. The base plate 36 has each side wall 40 with an outwardly projecting tab 39, the side walls 40, 40 being jointed with a longitudinal bar 41. The longitudinal bar 41 is formed with recesses 42 at its front side, the recess 42 being secured to the connector support 38 with bolts. Thereby, the connector support 38 is received in a space 43 surrounded by each side wall 40 of the longitudinal bar 41. Each tab 39 is received in a recess 45 formed in a frame 44 on the press-fitting apparatus 21 (FIG. 2) and is secured with a spring-loaded pin 46. Pulling out the pin 46 against the spring force releases the connector retaining bar 26 from the press-fitting apparatus 21.

The plurality of connector supports 36 respectively have a receiving recess 47 corresponding to an external form of one of various types of the press-fit connectors 11 so that the recess 47 can receive the relative press-fit connector 11. A support 381 having a receiving, vertically through recess $\mathbf{47}_1$ corresponds to the double-sided, press-fit type connector 11 shown in FIG. 24. Meanwhile, a support $\mathbf{38}_2$ having a receiving recess $\mathbf{47}_2$ with a bottom corresponds to a single-sided, press-fit type connector 11. The double-sided connector 11, as described later, corresponds to a press-fitting apparatus symmetrically disposed a couple of upper and lower press-fitting units 25. Preparing various types of the connector retaining bars 26 allows to fabricate various types of wiring harness subassemblies.

Figure 8:
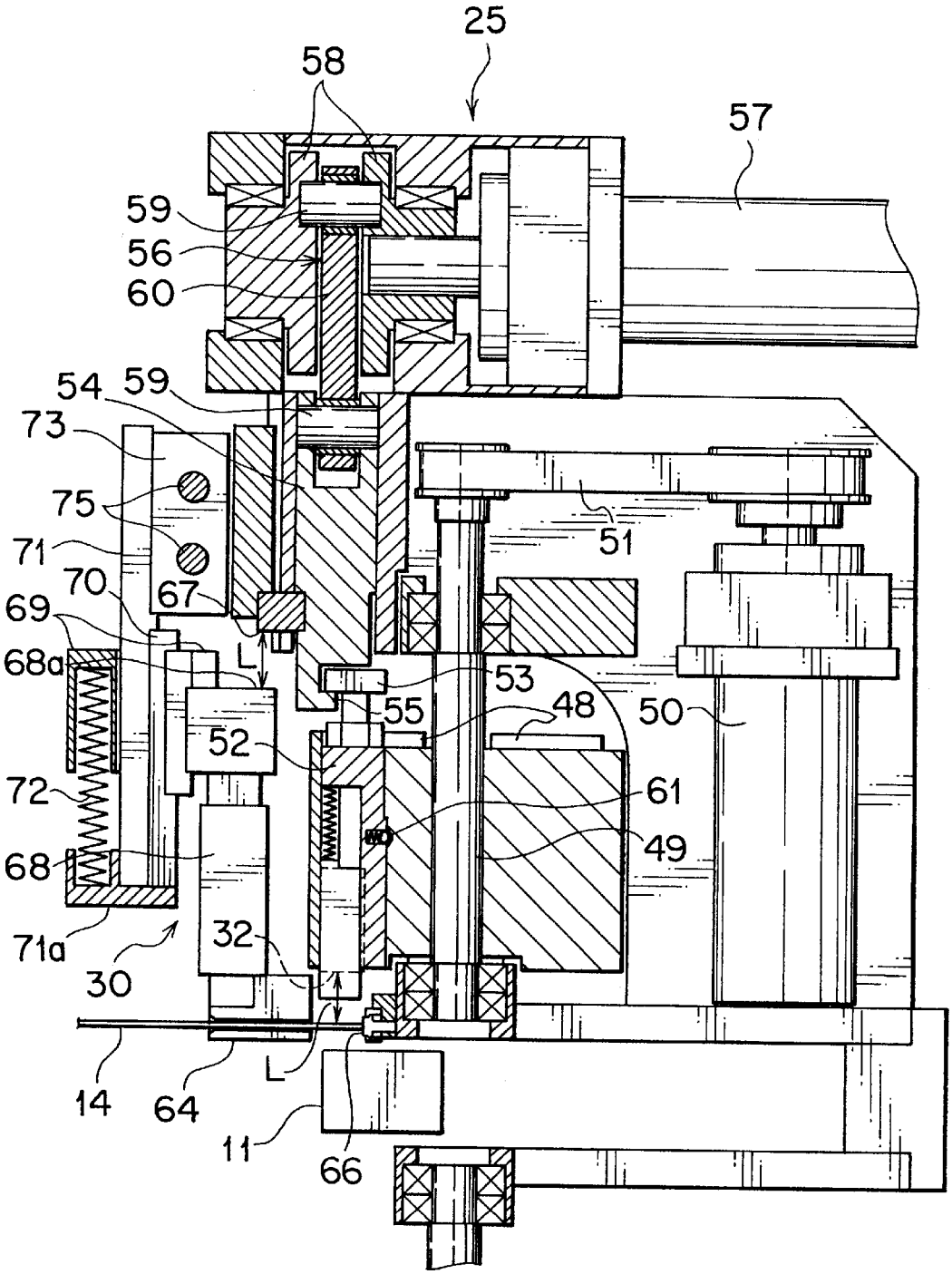
FIG. 8 is a side view showing a press-fitting unit according to the invention.
Figure 9:
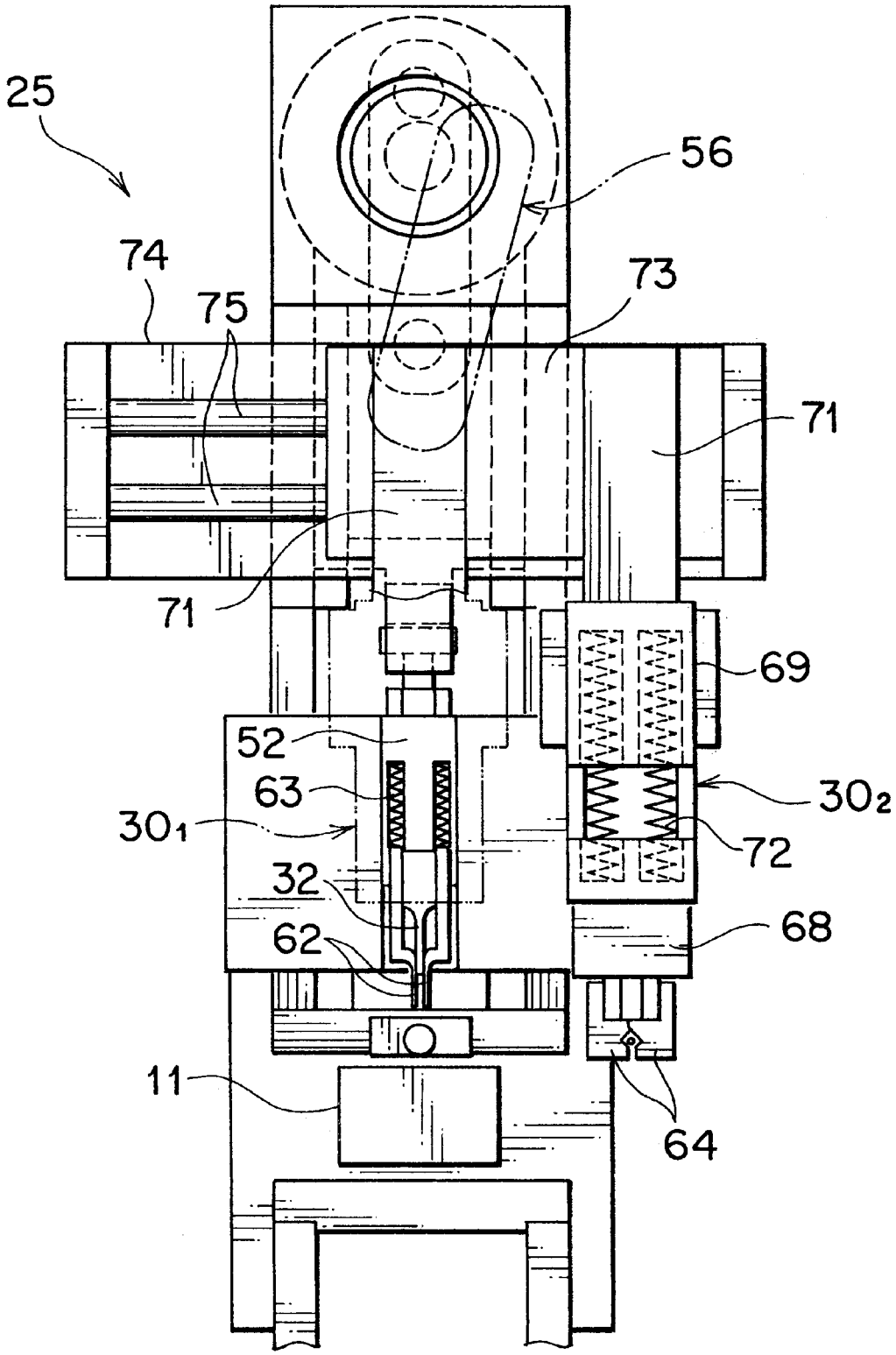
FIG. 9 is the front view of the press-fitting unit.

FIGS. 8 and 9 show the press-fitting unit 25 in detail.

This fitting unit 25 includes applicators 48 (FIG. 8) radially extending from a rotation axis 49 and having a press blade 32 corresponding to one of various types of wires in diameter. A servo-motor 50 turns the rotation axis 49 by way of a timing belt 51, thereby allowing selection of the applicators 48.

The applicator 48 includes a slider 52 having a press blade 32 fixed thereto. A shank 53 fixed on an upper end of the slider 52 engages with a hook 55 formed in another upper slider 54. The upper slider 54 joints to a crank mechanism 56 positioned above the slider 54 and driven by a motor 57 so as to move vertically. Besides, denoted 58 is a flywheel; 59 a connection pin; and 60 a connecting rod. The slider 52 is correctly positioned and provisionally jointed to the applicator 48 by a spring-loaded-ball-type plunger 61. Further, the downward movement of the slider 54 can releases the slider 52 from the provisional jointing to move downwardly.

Referring to FIG. 9, in each side of the press blade 32 are disposed a pair of wire slidable guides 62. The wire guide 62 is slidably, vertically movably supported by the slider 52 with a coil spring 63 therebetween. As is illustrated in FIG. 8, in front of the press blade 32 is disposed, clamped by a wire chuck 30 opposite thereto. This allows an end of the wire 14, clamped by a pair of chuck hooks 64, to be pushed into a press-fit terminal in a connector 11 for press-fit connection as shown in FIGS. 10A to 10C.

Figure 10A:
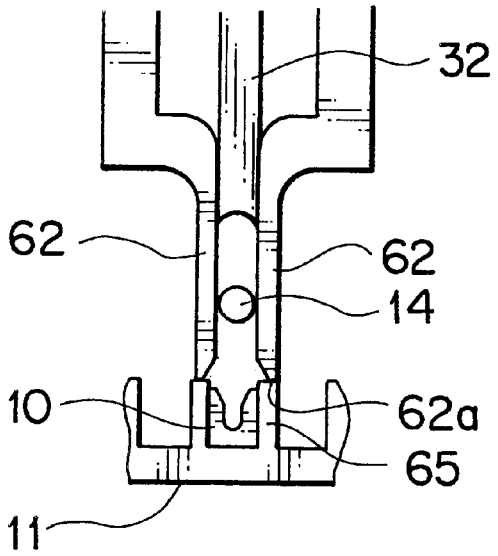
FIGS. 10A to 10C are explanatory views mainly showing action of a wire guide.
Figure 10B:
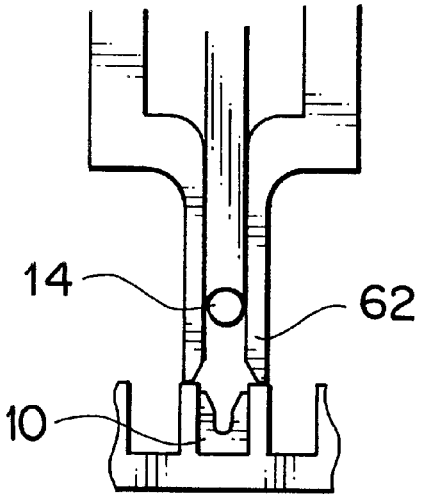
Figure 10C:
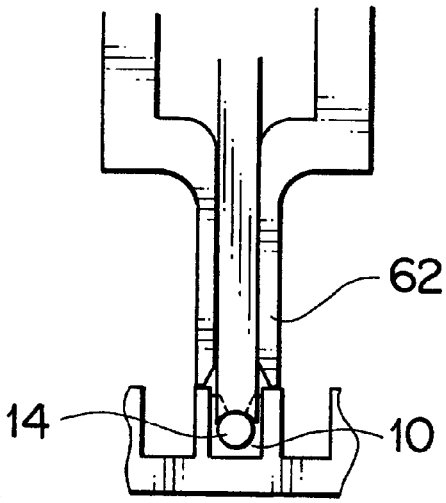

That is, the wire end 14 clamped by the chuck hooks 64, as shown in FIG. 10A, is located between the pair of wire guides 62. The downward movement of the slider 52 causes a leading end 62*a* of each of the guides 62 to abut against an upper end of a partition 65 for receiving a press-fit terminal in the connector 11. As shown in FIG. 10B, downwardly moving the press blade 32 allows the wire 14 to be delivered onto the press-fit terminal 10 along the guides 62. Finally, the wire can press-fit to the terminal 10 as shown in FIG. 10C.

In the case of double-sided press-fit-type connector 11 (FIG. 24), a pair of wire guides (the same ones as illustrated in FIG. 10) of a lower press-fitting unit 252 (FIG. 11) can abut against partitions 65 of a lower terminal receiving chamber in the connector 11. This allows the press-fit connector 11 to be supported by the lower unit 252. With the supporting condition, an upper press fitting unit $\mathbf{25}_1$ (FIG. 11) press-fits a wire 14 to a press-fit terminal 10 disposed in a terminal chamber as described above. The wire guides 62 with the coil spring 63 (FIG. 9) having been compressed to the maximum abuts against the partition 65 to the press-fit-terminal-type connector 11. When the press-fit terminal 10 received in the lower terminal chamber press-fits a wire 14, similarly, the upper wire guides 62 have abutted against the relative partitions 65 of the connector 11. The coil spring 63 have been compressed to the maximum. This prevents deformation of the connector 11 so that the wire 14 can be reliably press-fitted to the press-fit terminal 10.

In FIG. 8, denoted 66 is a switch for detecting the presence of a wire, the switch-on condition allowing the motor 57 to rotate. Regarding the wire chuck 30, an upper end face 68*a* (an abutting face) of a chuck activating cylinder 68 abuts against a relative abutting block 67 of the slider 54, and after the abutment, the wire chuck 30 moves downward together with the slider 52. A distance L between the abutting block 67 and the upper end face 68*a* of the cylinder 68 is the same as a distance between the wire 14 and the blade 32. The chuck 30 having released from the block 67 can lift along the upward movement of the slider 52, because the chuck 30 has resiliently jointed to the slider 52 by way of a coil spring 72. The chuck 30 comprises the chuck the cylinder 68 for opening and closing a pair of chuck hooks 64, a spring holder 69 unitedly jointed to the chuck the cylinder 68, a vertical guide 70 for slidably elevating the chuck the cylinder 68, a chuck the stay 71 including the guide 70 and extending upward, the coil spring 72 compressed and attached between a lower part 71*a* of the stay 71 and the spring holder 69 so as to lift the chuck the cylinder 68 up to the highest position.

The chuck stay 71 is secured to a horizontal the slider 73 (a rod-less cylinder) 73. The slider 73, as shown in FIG. 9, is horizontally movable along a couple of horizontal guide the bars 75 fixed on a fore side frame 74 of the press fitting unit 25. There are provided a couple of left and right wire chucks 30, each having the chuck the stay 71 unitedly fixed to the horizontal slider 73.

While one chuck $\mathbf{30}_1$ stays in the middle of the guide the bar 75 so as to align with the press blade 32, the other chuck 302 is at one end of the guide bar 75, allowing a worker to supply or receive the wire 14.

Figure 11:
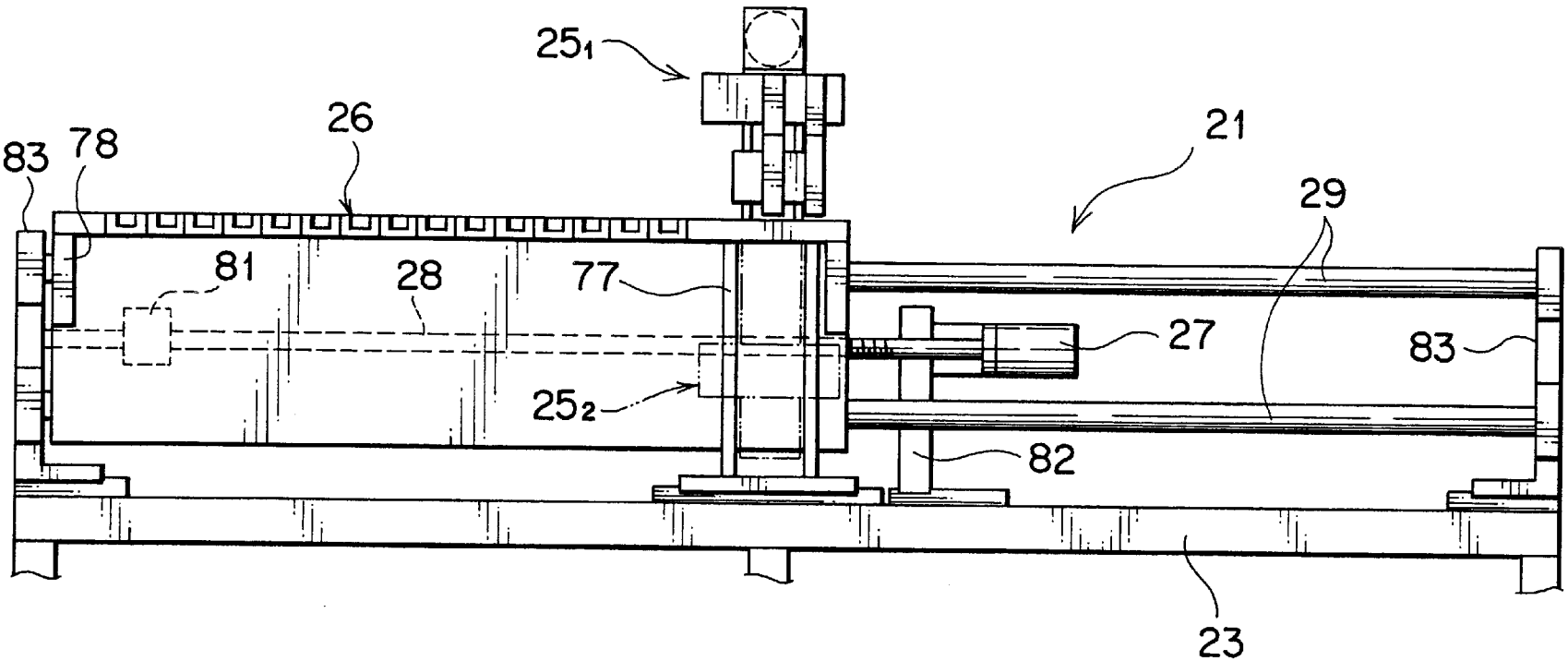
FIG. 11 is the front view showing a first embodiment of a press-fitting apparatus.
Figure 12:
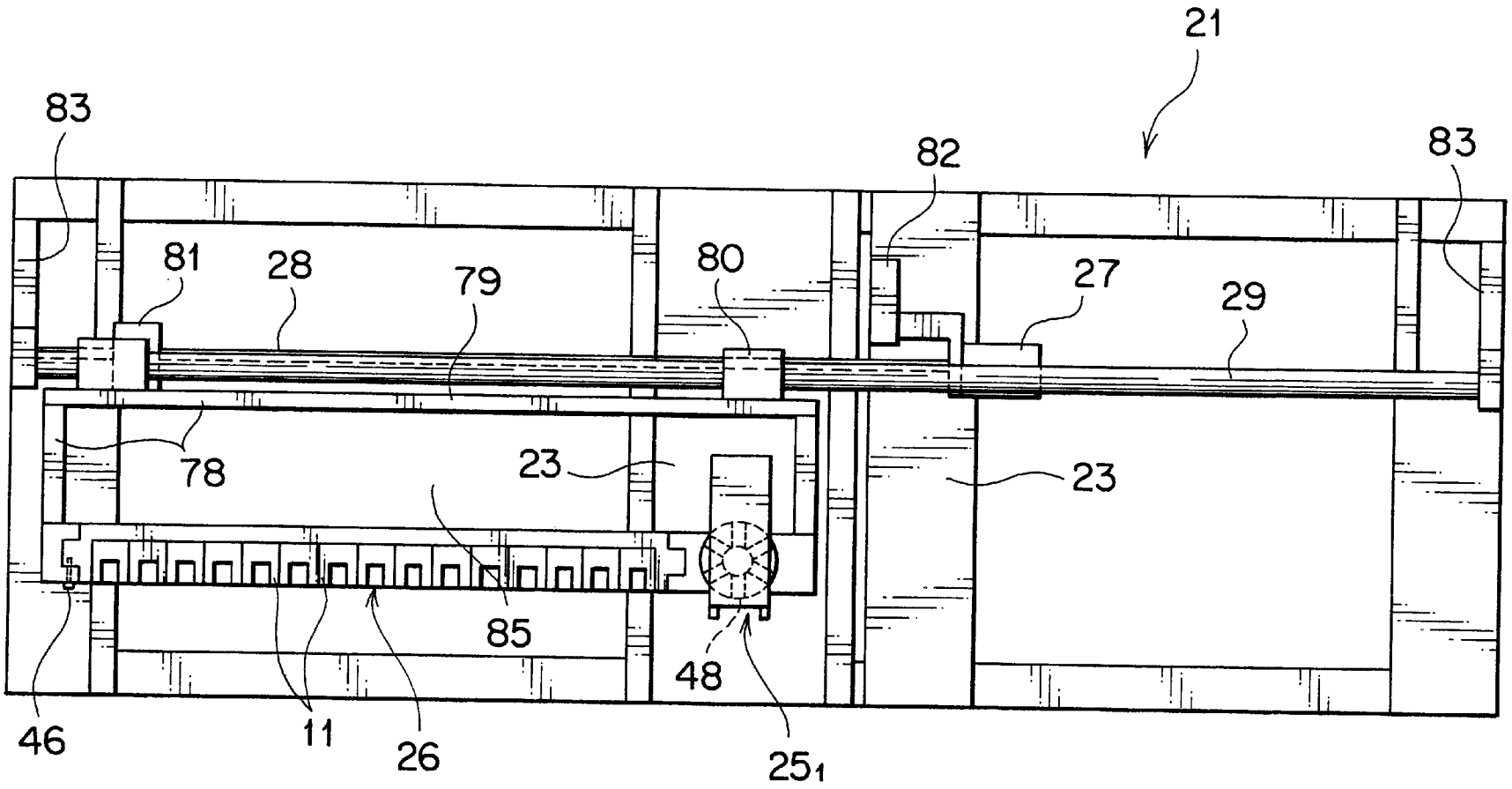
FIG. 12 is a top view of the first embodiment.
Figure 13:
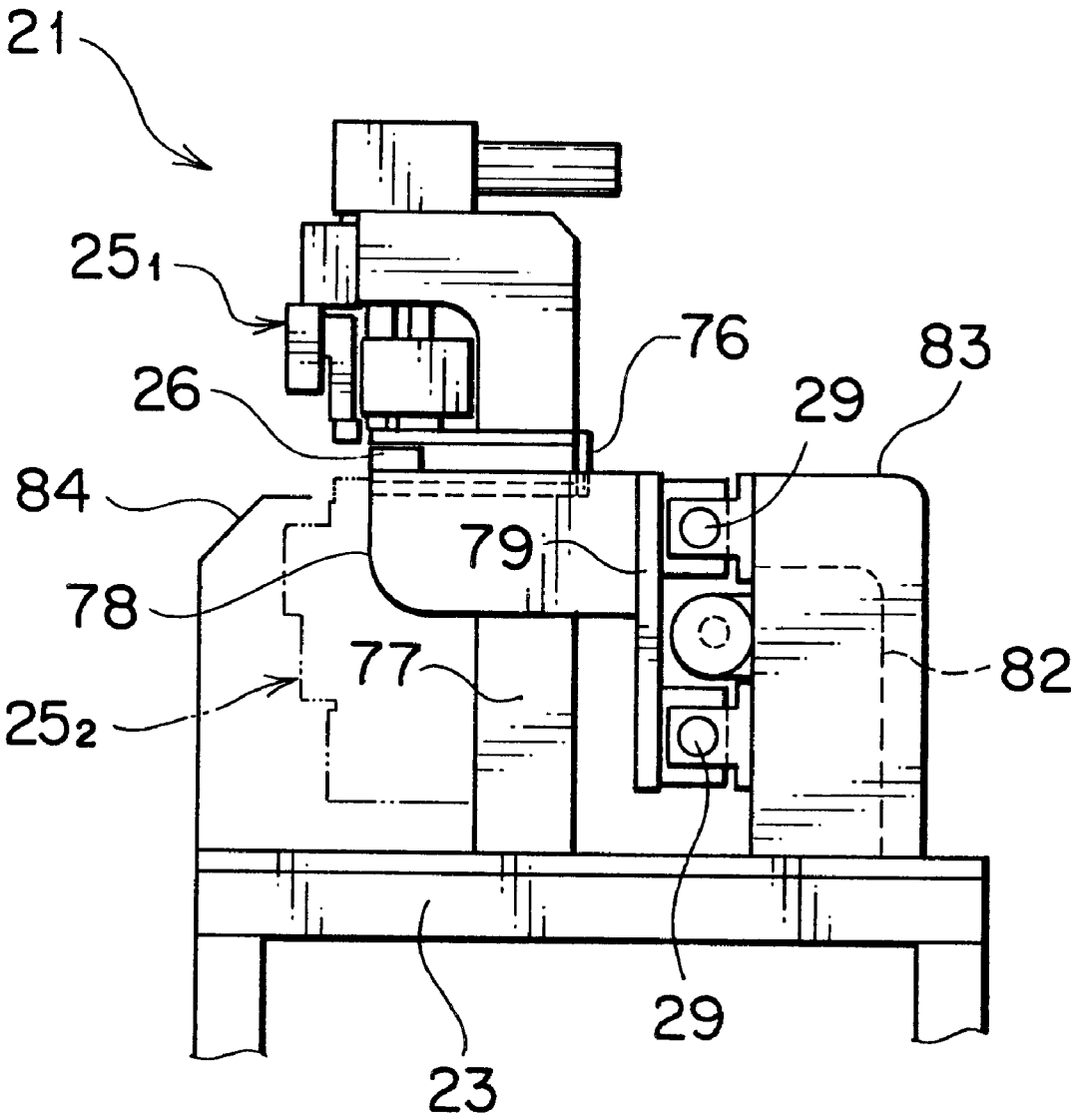
FIG. 13 is a side view of the first embodiment.

FIGS. 11 to 13 show one example 21 (a first embodiment) of a press-fitting apparatus utilizing the aforementioned press-fitting unit 25.

A couple of press-fitting units 25 are fixed on the base plate 76 (FIG. 13) in the middle of a base frame 23, each of the units being symmetrically disposed above and under the base plate 76. The base plate 76 is fixed to the base frame 23 by way of support pillars 77. Between the upper and lower press-fitting units 251, 252 is disposed the connector retaining bar 26 movable in a longitudinal direction of the frame.

That is, the connector retaining bar 26 is removably attached fixed on a fore part of a movable quadrangular frame 78 (FIGS. 11 to 13) by a spring-loaded pin 46. The movable frame 78 has a rear vertical wall 79 fitted with a slide guide 80 (FIG. 12). The slide guide 80 slidably engage with a horizontal guide bar 29. Further, the vertical wall 79 fixed with a driven block (a nut) 81 engaging with a rolled thread rod 28 that connects to the servo-motor 27. These transfer mechanisms 27, 28, and 29 can move the frame 78 unitedly with the connector retaining bar 26.

The press-fitting unit 25 is located in a space 85 inside the movable rectangular frame 78. The servo-motor 27 is fixed on support pillars 82 fitted on the base frame 23. A side wall 83 of the base frame 23 axially rotationally supports an end of the threaded rod 28 and also holds each end of the guide bar 29. As shown in FIG. 12, the press-fitting unit 25 has several types of selective, radially extending applicators 48.

As shown in FIG. 13, in front of the connector retaining bar 26 there is arranged a cover 84 preventing twine of the wire 14 during transferring of the connector retaining bar.

Thence, horizontally transferring the connector retaining bar 26 allows a desired connector 11 held by the bar to be positioned just under the press-fitting unit 25. Thereby, the press blade 32 can press-fit the wire 14 to the desired press-fit terminal 10. Selection method of the connectors 11 is determined by data preliminarily imputed in a control section (not shown).

Figure 24:
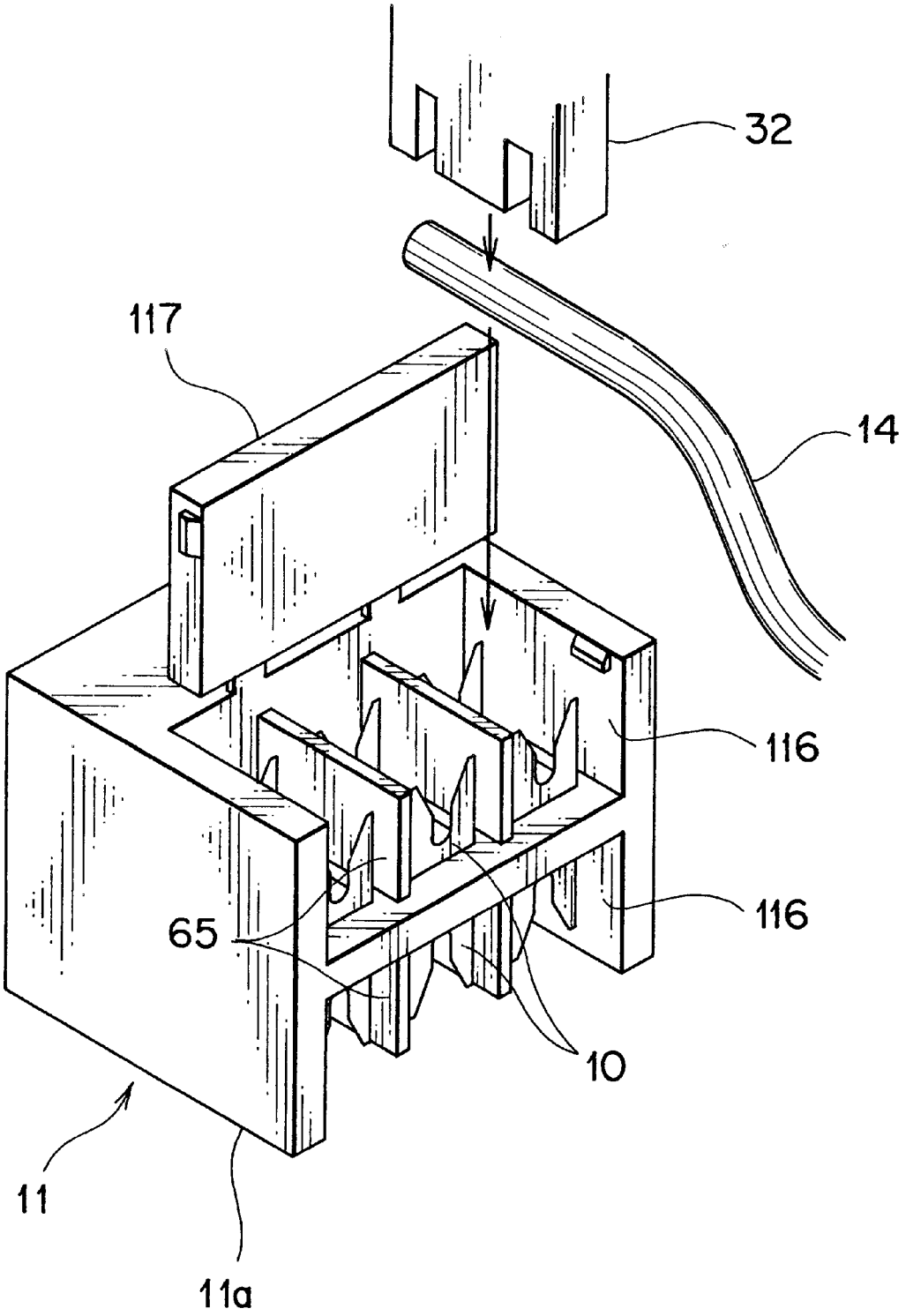
FIG. 24 PRIOR ART
FIG. 24 is a perspective view showing a known step of press-fitting a wire to a connector.

In this embodiment, the arrangement of the press-fitting units $\mathbf{25}_1$, $\mathbf{25}_2$ positioned respectively above and under the connector retaining bar 26 allows the wire 14 to be efficiently automatically press-fitted to the upper and lower terminals 10 disposed in the double-sided connector 11 (FIG. 24).

Figure 14:
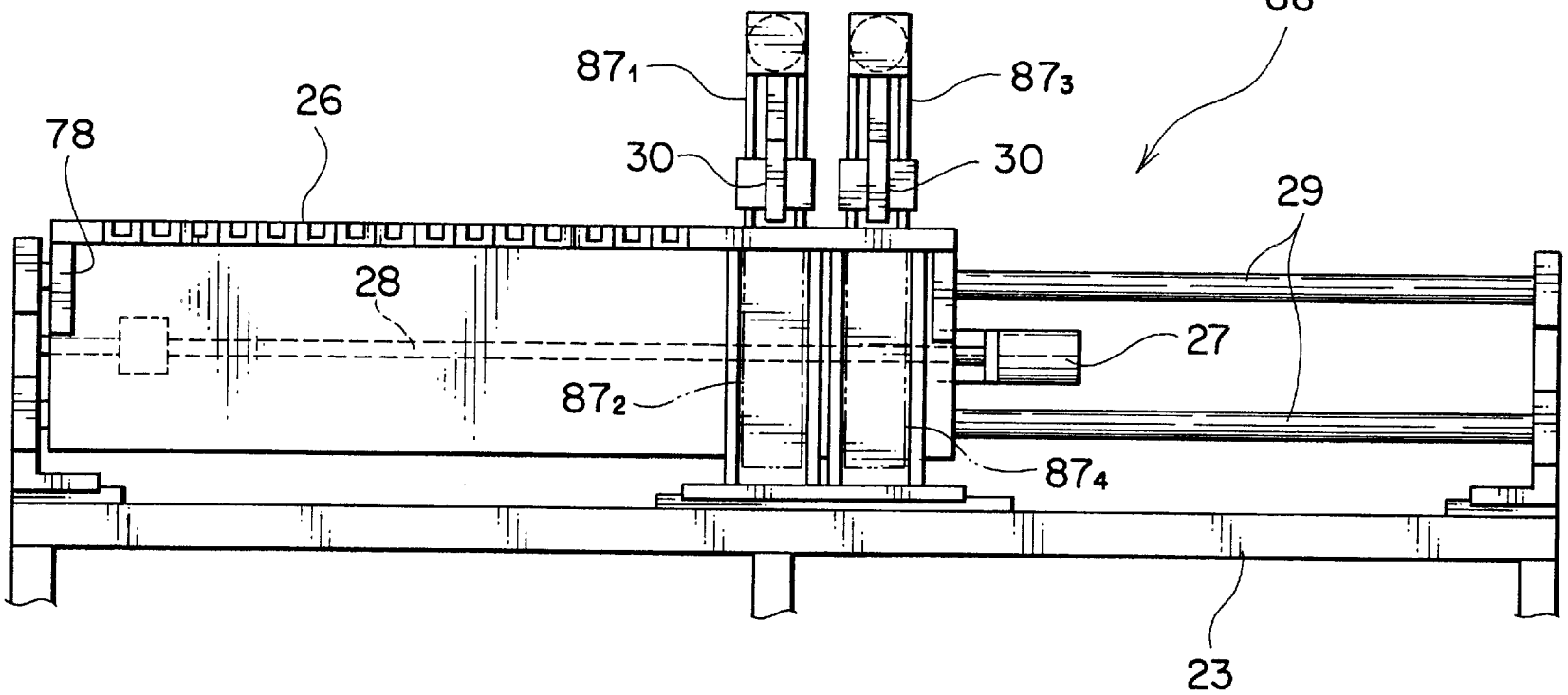
FIG. 14 is the front view showing a second embodiment of the press-fitting apparatus.
Figure 15:
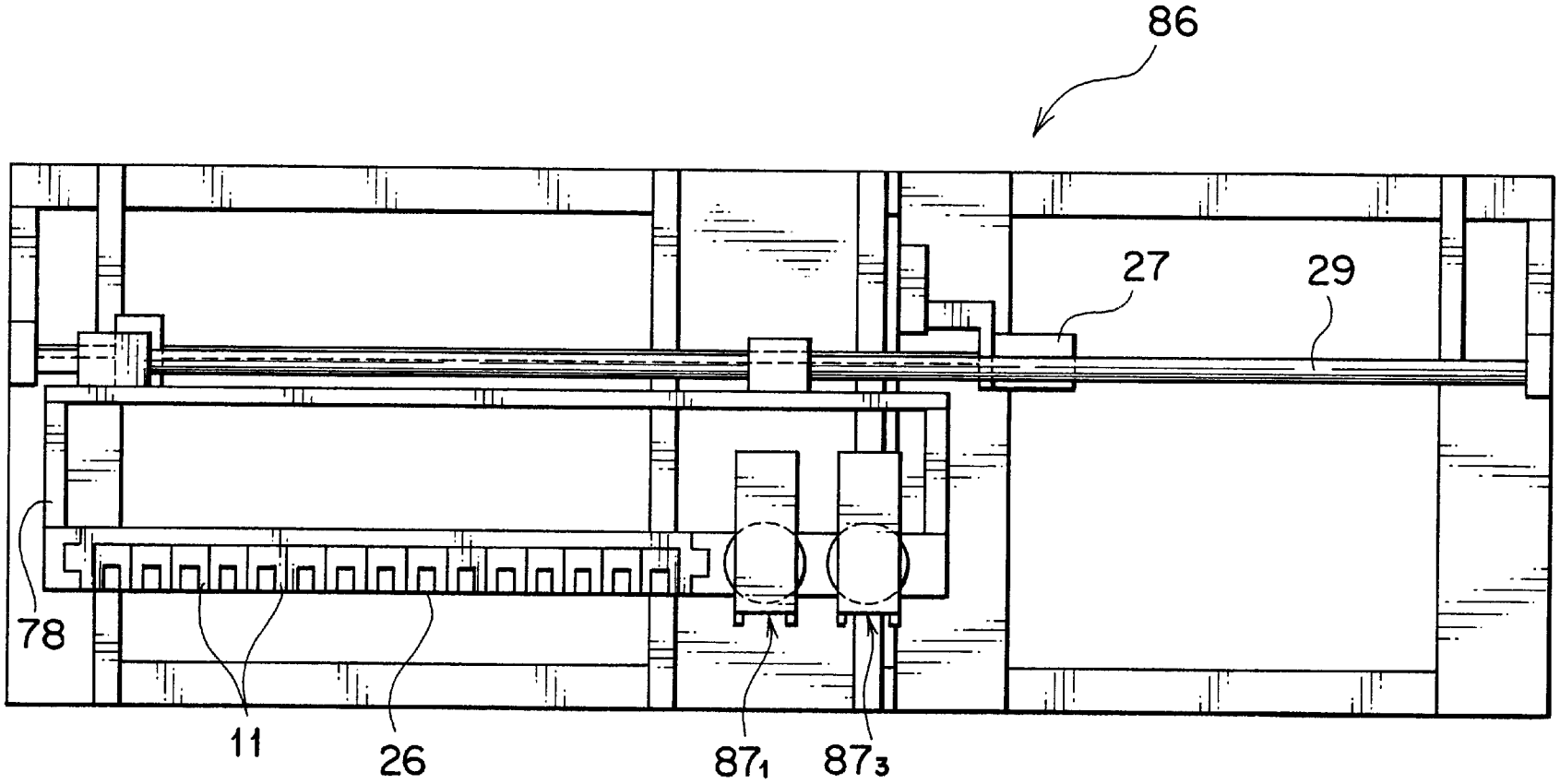
FIG. 15 is a top view of the second embodiment.

FIGS. 14 and 15 shows a second embodiment of the press-fitting apparatus.

This press-fitting apparatus 86 includes two pairs (four units) of the upper and lower press-fitting units 87 related to the connector retaining bar 26. The press-fitting units $\mathbf{87}_1$ to $\mathbf{87}_4$ do not have the above-mentioned pair of the slidable wire chucks $\mathbf{30}_1$ $\mathbf{30}_2$ but respectively have a wire chuck 30 fixed to a respective unit. The wire chuck 30 is arranged in the middle of the crimping unit 87, that is, in front of the press blade 32 (FIG. 8).

Except the above-mentioned mechanism, the second embodiment is the same as the first one. Each of the press-fitting units 87 is fixed to the frame 23. The movable frame 78 mounted with the connector retaining bar 26 longitudinally moves forward and backward along the base frame by means of the transfer mechanism composed of the motor 27, the threaded rod 28, and the guide the bar 29.

In the embodiment, for example, one $\mathbf{87}_1$ of the upper crimping units has been press-fitting a wire to a connector 11, the wire chuck 30 of the other press-fitting unit $\mathbf{87}_3$ can receive another wire from a setting rack (not shown). This allows the absence of the horizontally sliding unit 74(FIG. 9) of the chuck that requires high accuracy in positioning.

Figure 16:
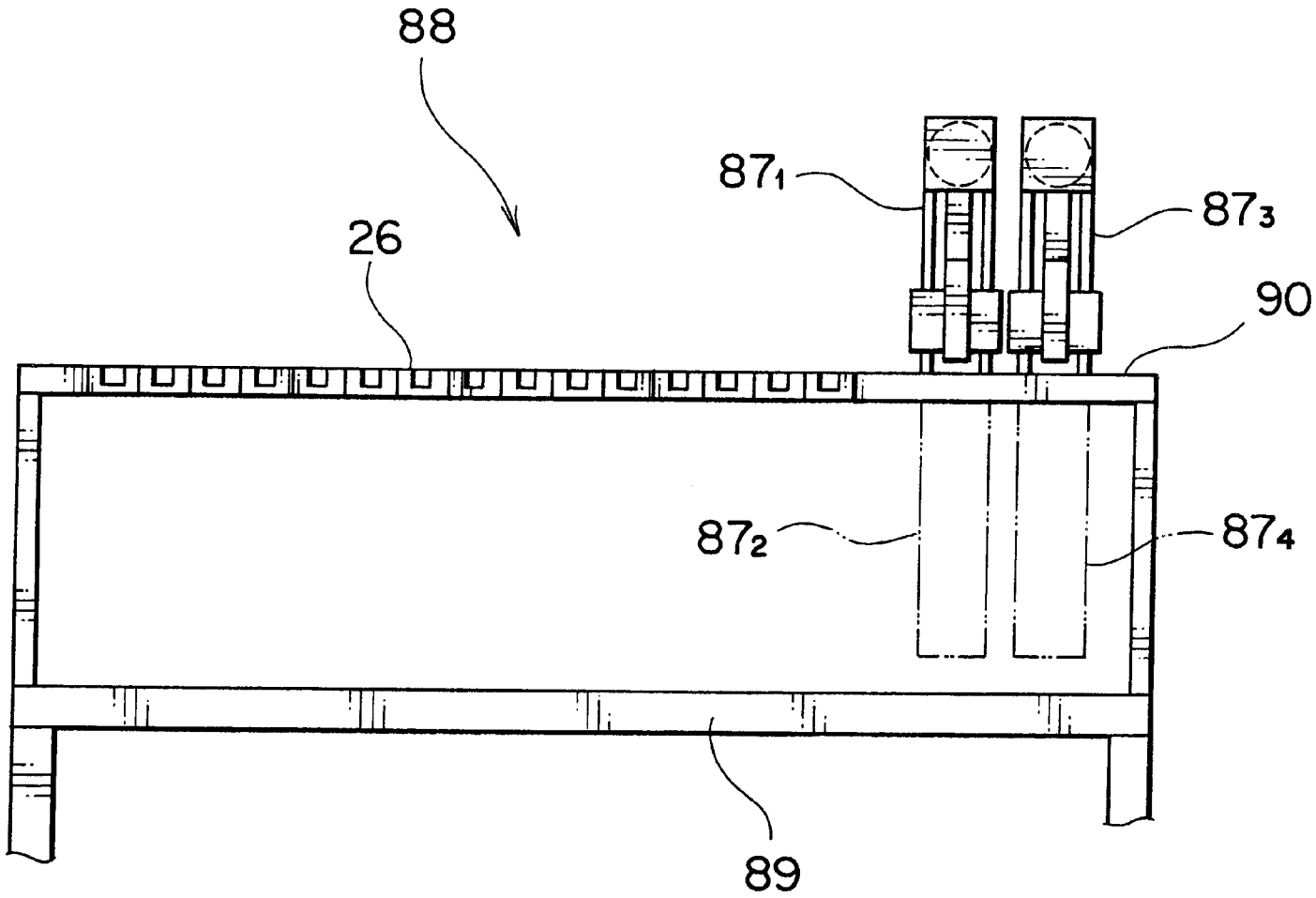
FIG. 16 is the front view showing a third an embodiment of the press-fitting apparatus.
Figure 17:
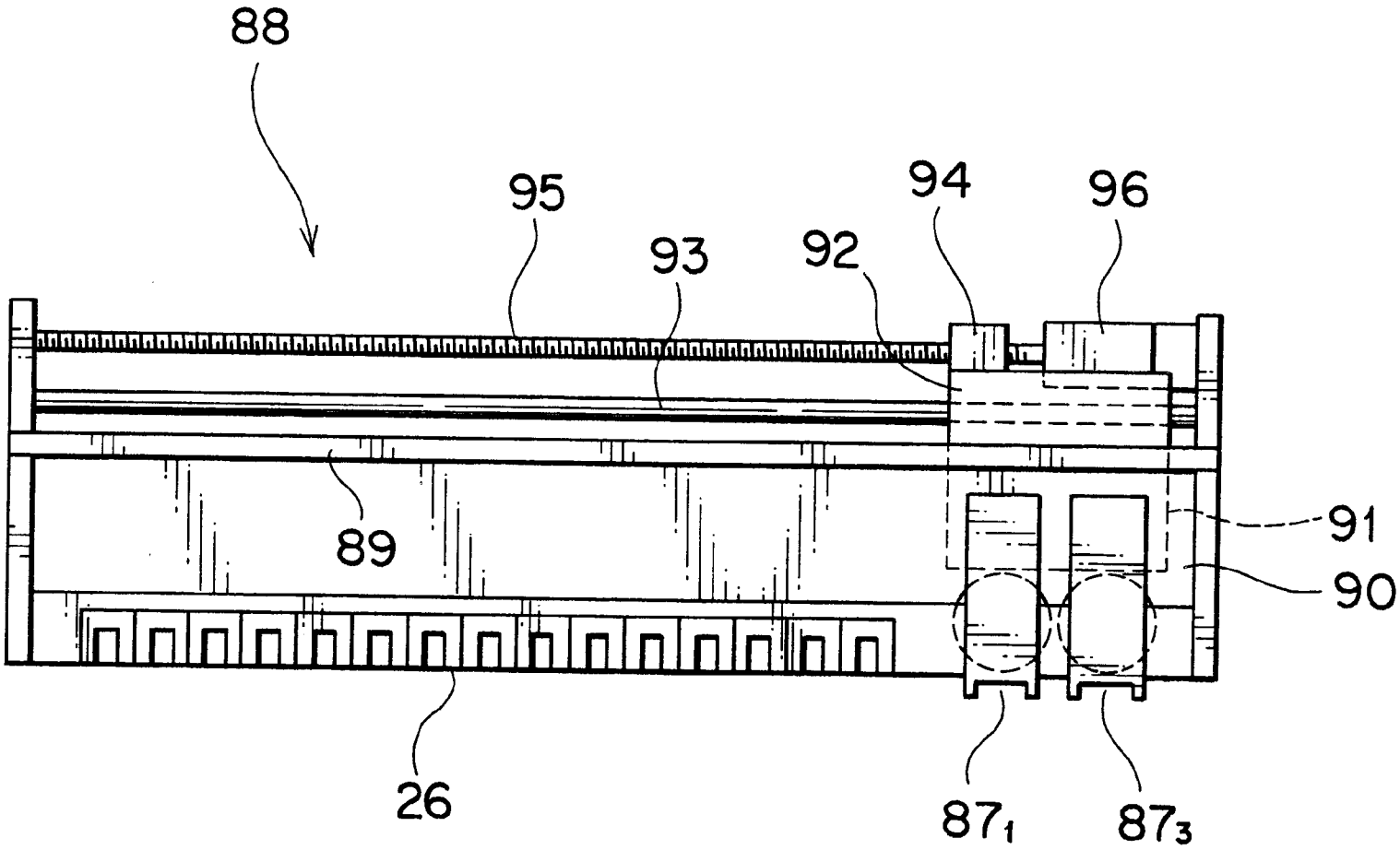
FIG. 17 is a top view of the third embodiment.
Figure 18:
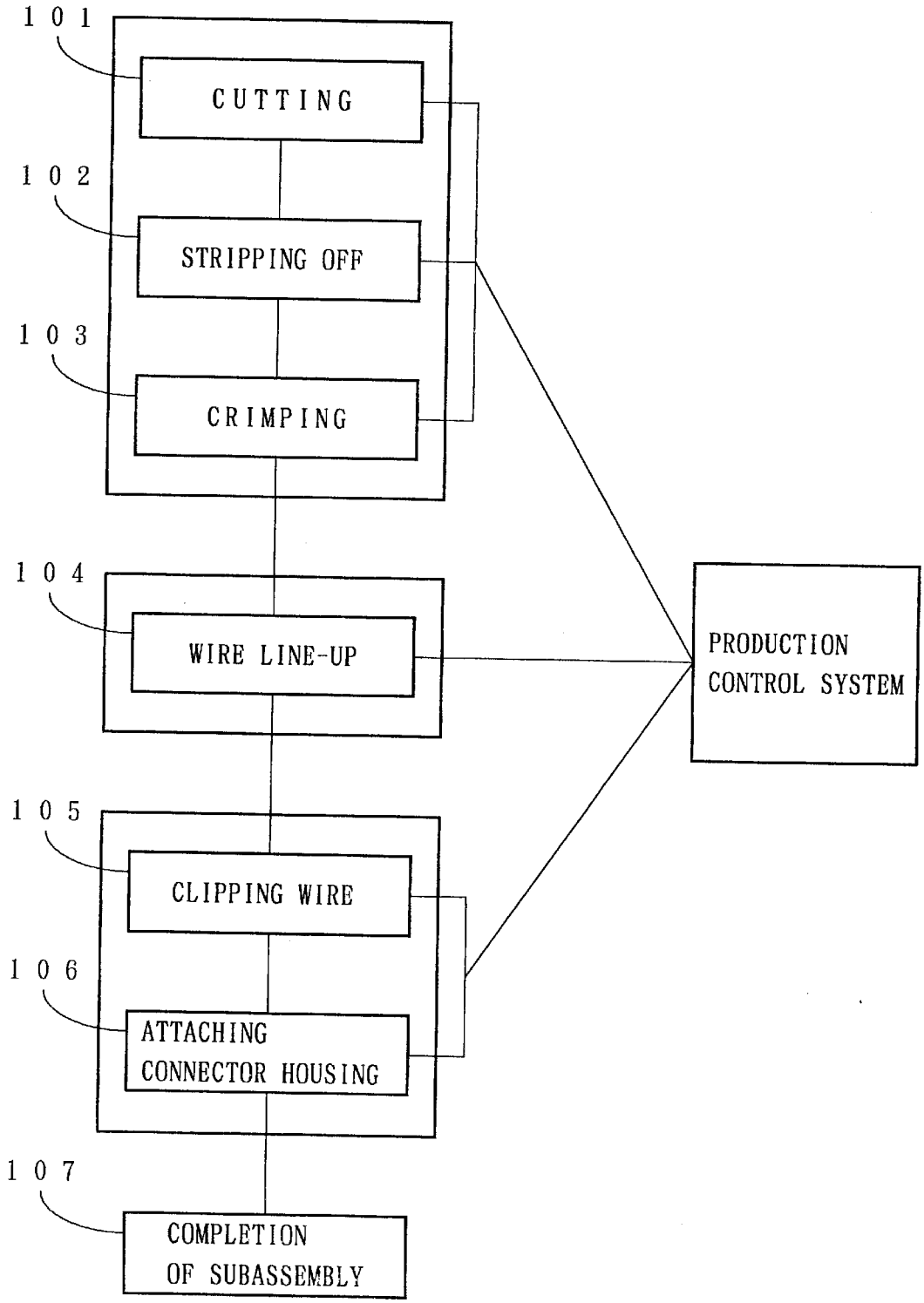
FIG. 18 PRIOR ART
FIG. 18 is a block diagram showing a known crimping-type wiring harness manufacturing method.
Figure 19:
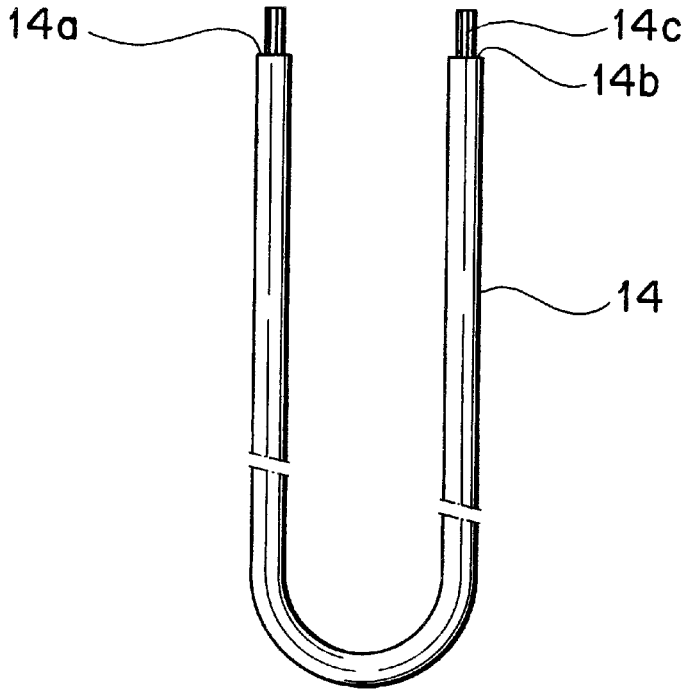
FIG. 19 PRIOR ART
FIG. 19 is a top view showing a wire having been stripped at each end thereof.
Figure 20:
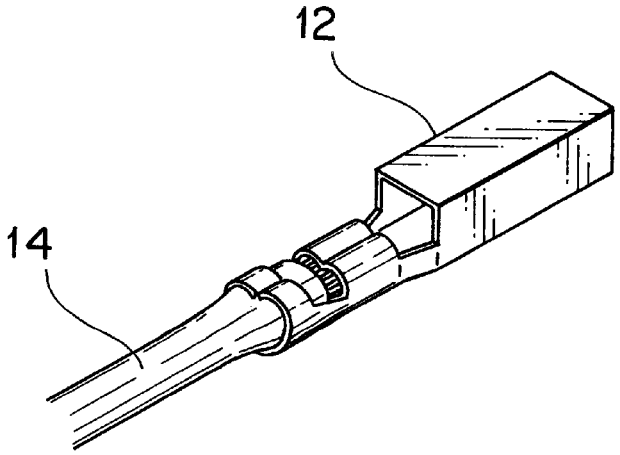
FIG. 20 PRIOR ART
FIG. 20 is a perspective view showing the wire having been crimped to a terminal.
Figure 21:
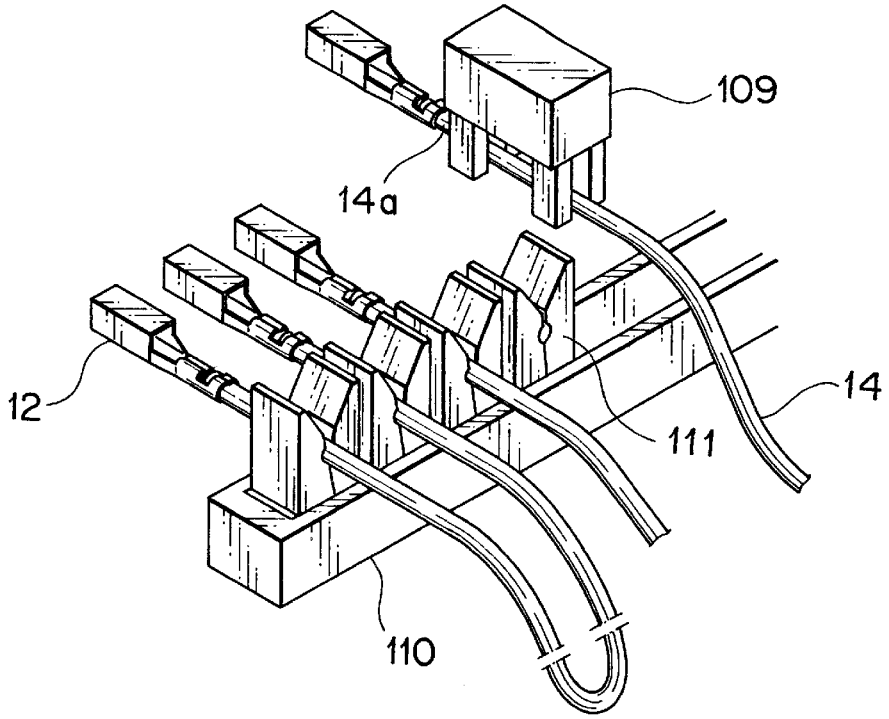
FIG. 21 PRIOR ART
FIG. 21 is a perspective view showing the wires with the terminals, particularly illustrating a step of striking the wire into a wire holding bar.
Figure 22:
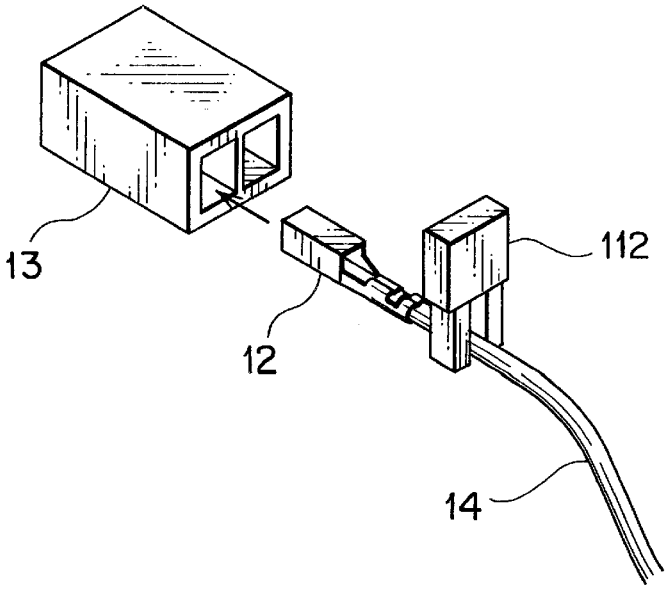
FIG. 22 PRIOR ART
FIG. 22 is a perspective view showing a step of inserting the crimped terminal to a connector housing.
Figure 23:
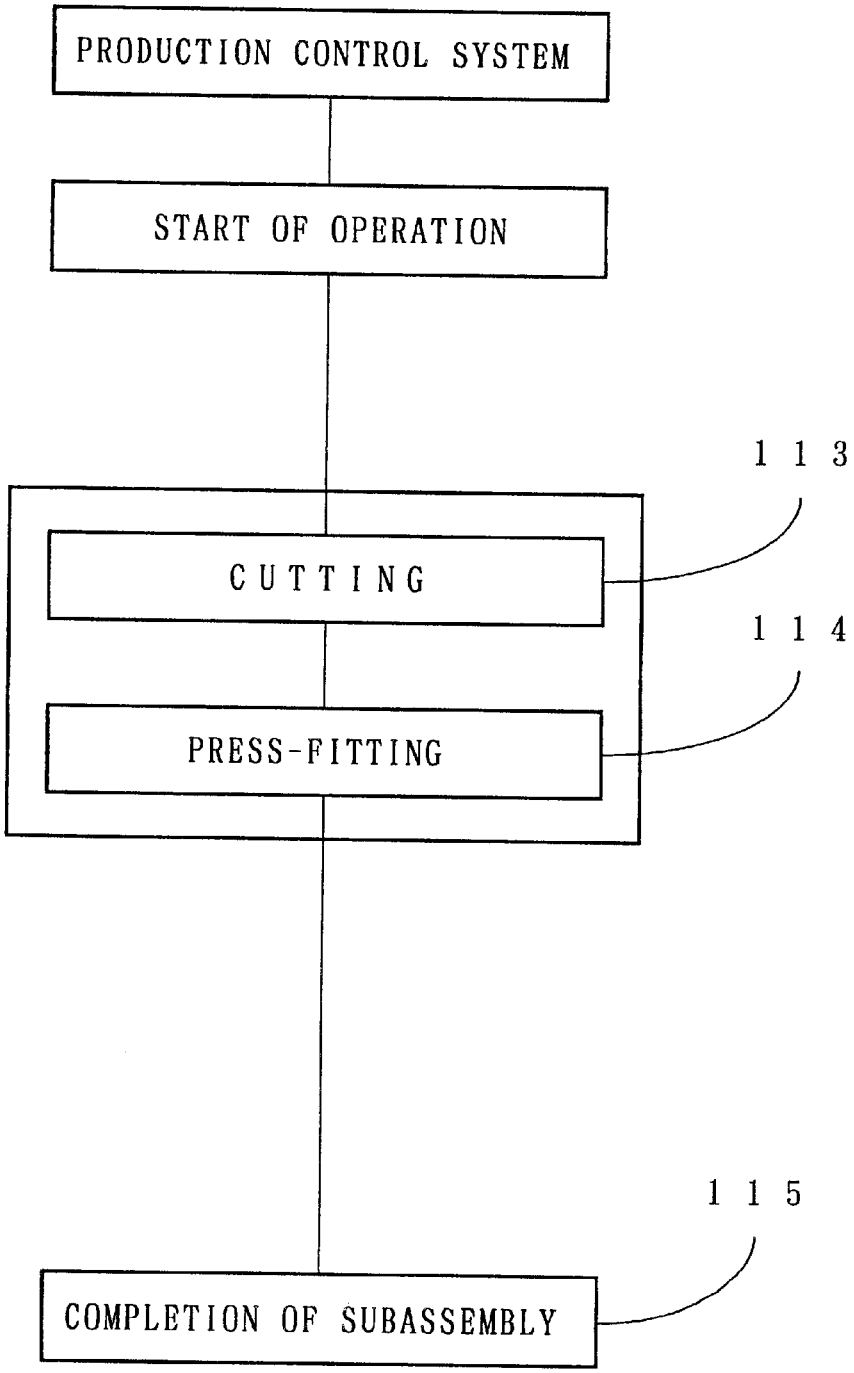
FIG. 23 PRIOR ART
FIG. 23 is a block diagram showing a known press-fit-type wiring harness manufacturing method.

FIGS. 16 and 17 shows a third embodiment of the press-fitting apparatus.

This press-fitting apparatus 88 includes a connector retaining bar 26 fixed to a frame 89. A press-fitting unit 87 is horizontally movable along the frame 89 to the stationary connector retaining bar 26.

The over all length of the frame 89 is approximately a half of those of the two previously described embodiments. The connector retaining bar 26 extends from one end of the frame 89 to the other end thereof. In a space 90 between the connector retaining bar 26 and the other end of the frame there have been arranged two pairs of upper or lower press-fitting units $\mathbf{87}_1$ to $\mathbf{87}_4$. Each of the press-fitting units 87 is secured unitedly to a common base plate 91. The base plate 91 has a slide guide 92 engaging with a guide bar 93 and has a driven member (a nut) 94 engaging to a ball-screw threaded rod 95. The threaded rod 95 has jointed to a servo-motor 96.

As the press-fitting unit 87 moves horizontally, wire chucks may be better mounted around the connector retaining bar (in the fixed the frame). In the middle of the press-fitting units 87 there may be arranged a wire chuck 30 in the same way as the second embodiment. Two pairs of upper and lower press-fitting units 87 may be provided as described in the first an embodiment. The short over all length of the frame 89 that is only a little longer than the connector retaining bar 26 allows the press-fitting apparatus to be minimized in size.

Operational effects of the invention will be discussed hereinafter.

As mentioned above, the manufacturing method of the wiring harness according to the invention can give a wiring harness including both crimped terminals and press-fitted terminals. Thereby, connectors with press-fit terminals popular in recent years and conventional connectors with crimped terminals can coexist in their application.

Further, in the manufacturing method of the wiring harness utilizing the connector retaining bar and the press-fitting apparatus, the step of press-fitting the wire to the press-fit-terminal-type connector can accomplish plural jobs. The plural jobs include striking the other end of the wire having a crimped terminal into a clip mounted on a wire holding beam, removing the wire from the clip, and inserting the crimp terminal into the connector housing. Further, after completion of the press-fitting, wiring harness subassemblies on every connector retaining bar are supplied, which greatly improves the producing process of the wiring harness in efficiency, workability, and productivity.

Moreover, the press-fitting unit can reliably press-fit an end of the wire to the relative terminal with the wire having been held by the wire chuck. In the press-fitting unit, while one of the wire chucks has held a wire for press-fitting, the other wire chuck can receive a next wire. This causes an improved efficiency in production. Further, in the press-fitting unit, the wire advances along the guide into the press-fit-type terminal, allowing positive press-fitting to improve-connection in reliability.

Moreover, in the press-fitting apparatus shown in FIGS. 11 to 13, the wire chuck of the crimping unit can catch a wire during the horizontal movement of the connector retaining bar, which improving productivity of the fabrication. In the press-fitting apparatus shown in FIGS. 14 to 17, the fitting unit trips round along the connector retaining bar, which enabling a smaller system than the one having a transferring connector retaining bar. Selectively, the press-fitting apparatus can press-fit wires to each side of a double-sided, press-fit-terminal-type connector. The arrangements shown in FIGS. 10A to 10C prevent deformation of the connector housing during the press-fitting operation of the received terminals, allowing reliable work thereof.

What is claimed is:

1. A manufacturing method of a wiring harness comprising the steps of:

stripping off one end of an electrical wire;

crimping the one end of said wire to a crimping terminal;

press-fitting the other end of the wire in a terminal of a connector; and inserting the crimped terminal into a connector housing, which accomplishing a wiring harness subassembly having both the crimped wire end and the press-fitted wire end.

* * * * *